United States Patent [19]

Biton

[11] Patent Number: 4,831,995

[45] Date of Patent: May 23, 1989

[54] INTEGRATED IGNITION-TRANSFORMER ASSEMBLY FOR THE CYLINDER OF A CONTROLLED IGNITION HEAT ENGINE

[75] Inventor: Philippe F. M. Biton, Caluire, France

[73] Assignee: Societe a Responsabilite Limitee: L'Electricfil Industrie, Paris, France

[21] Appl. No.: 201,453

[22] Filed: Jun. 2, 1988

[51] Int. Cl.[4] ..... F02P 9/00; F02P 15/00

[52] U.S. Cl. ..... 123/635

[58] Field of Search ..... 123/635, 647, 650, 634, 123/143 C, 60 J, 146.5 R, 595

[56] References Cited

U.S. PATENT DOCUMENTS

| | | | |
|---|---|---|---|
| 3,792,694 | 2/1974 | Branholts | 123/635 |
| 4,275,334 | 6/1981 | Beeghly | 123/635 |
| 4,502,454 | 3/1985 | Hawai et al. | 123/635 |
| 4,615,922 | 5/1987 | Gillbrand et al. | 123/635 |
| 4,617,907 | 10/1986 | Johansson et al. | 123/635 |
| 4,671,248 | 6/1987 | Gillbrand et al. | 123/635 |
| 4,706,638 | 11/1987 | Johansson et al. | 123/635 |
| 4,706,639 | 11/1987 | Boyer et al. | 123/635 |
| 4,715,337 | 12/1987 | Bobl et al. | 123/635 |
| 4,751,430 | 6/1988 | Müller et al. | 123/635 |

FOREIGN PATENT DOCUMENTS

| | | |
|---|---|---|
| WO/86/044-80 | 8/1986 | Dominican Republic . |
| DE-U-8518139 | 11/1986 | Fed. Rep. of Germany . |
| 1122367 | 8/1968 | United Kingdom . |

OTHER PUBLICATIONS

Patent Abstracts of Japan, vol. 7, No. 44 (M-195), (2/83), Describing JP-A-57193776, Published Feb. 22, 1983.

Patent Abstract of Japan, vol. 9, No. 103 (M-377) (5/85), Describing JP-A-59226279, Published 12/19/84.

Patent Abstracts of Japan, vol. 10, No. 44 (M-455) (2/86), Describing JP-A-60195374, Published 10/3/85.

Patent Abstracts of Japan, vol. 1, No. 23, (3/77), pp. 1767 M 76, Describing JP-A-51137011, Published 11/26/76.

*Primary Examiner*—Raymond A. Nelli

*Attorney, Agent, or Firm*—Bacon & Thomas

[57] ABSTRACT

An integrated ignition-transformer assembly for the cylinder of a heat engine having controlled ignition, the assembly being of the type comprising a tubular body (11) delimiting: an internal shoulder (12), mounting means (13) on one side of said shoulder for mounting on the stem of a spark plug (15), and a housing (14) on the other side of said shoulder containing an axially fixed transformer coil (24) which is encapsulated in a dielectric coating (25) and which includes a terminal (30) for making contact with the spark plug; said mounting means (13) being constituted by disconnectably fixing means for co-operating with a complementary thread provided on the base (17) of an adopted spark plug; and said terminal (30) being in contact with the terminal pin (35) of a spark plug and being surrounded by an internal sleeve (32) of dielectric material which extends said transformer coil (24) to said shoulder (12), and which is intended to receive, in sealed manner, the stem (16) of the spark plug on which the assembly is mounted.

10 Claims, 2 Drawing Sheets

Fig-1
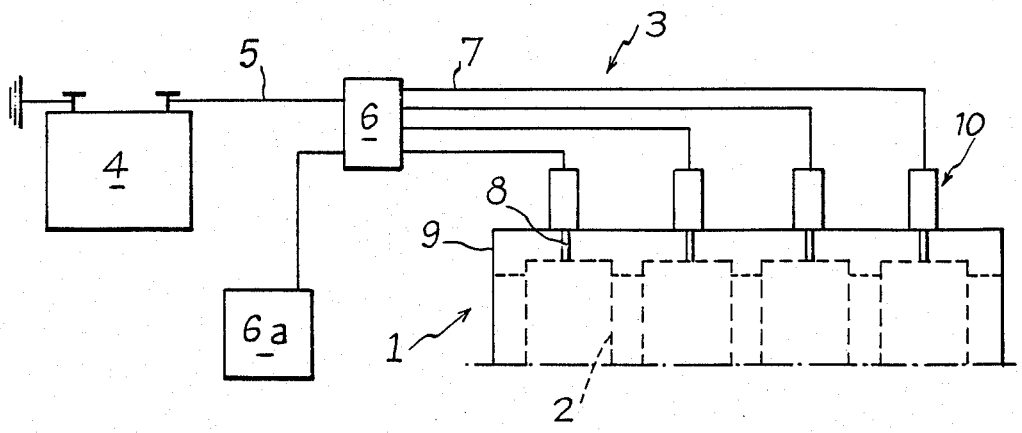
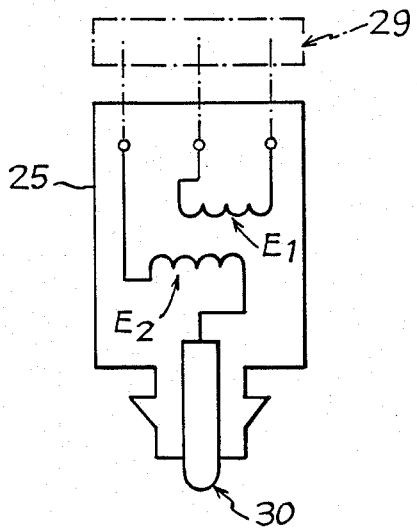
Fig-3

INTEGRATED IGNITION-TRANSFORMER ASSEMBLY FOR THE CYLINDER OF A CONTROLLED IGNITION HEAT ENGINE

The invention relates to the technical field of heat engines, and more particularly to internal combustion engines having controlled ignition.

BACKGROUND OF THE INVENTION

Engines of the above type have a spark plug for each of their cylinders, said spark plug being mounted on the cylinder head so that its electrodes are disposed inside the combustion chamber of the cylinder. Such a spark plug is fed with electricity in order to produce an ignition spark between its electrodes for each cylinder operating cycle.

Hitherto, such a spark plug has been fed with electricity from an electricity-producing source by making use of a transformer coil which receives low voltage electricity from the source and which is connected by a high tension cable to a mechanical distributor which is generally of the rotating wiper type and which is in turn connected by high tension cables to each of the spark plugs of the engine.

Such an installation is known firstly as being a source of electrical leakage due mainly to the length of high tension cable and to the presence of dampness and to deposits of various substances which encourage the retention of dampness, and secondly as emitting interference which spoils proper operation of radio installations.

The loss of energy due to said leaks must be compensated by using means capable of producing higher tension, thereby giving rise to even greater leakage.

In order to remedy some of the known drawbacks of the installations of the above type, proposals have been made to replace the mechanical distributor by an electrical distributor. Although this proposal avoids the drawbacks due to the rotating wiper and to electrical flashover between fixed points, it nevertheless fails to reduce the length of high tension cable between the various components of the installation.

Another prior art proposal has been to place electronic distribution on a low tension cable leading to a multi-outlet transformer group with its outlets connected by high tension cables to the various spark plugs.

This proposition omits the high tensions links between the coil and the distributor, but it retains the high tension cables which exist between the transformer group and the various ignition spark plugs.

The prior art also describes proposals for fitting an individual coil assembly on each spark plug. This applies, in particular, to the proposals in the following documents: DE-U-G 85 18 139.0, JP-A-57 193 776, JP-A-60 195 374, JP-A-51 137 011, JP-A-59 266 279, WO-A-86 04 480.

All of the proposals put forward in the above documents have the common feature of disposing the transformer assembly in a body which is extended by an end fitting or sleeve which is fitted over the porcelain stem of a spark plug. The consequence of this form of construction with the mass of the assembly being located at a head end is to impose reciprocating stresses on the stem due to vibration when the engine is running, and spark plug stems are not generally designed to withstand such mechanical forces. This gives rise to partial or total deterioration of the plug spark which is then no longer capable of performing its function.

All of these proposals also share the feature of not providing adequate electrical screening of the coil and the spark plug in order to reduce or eliminate the emission of radio interference. It also appears that these proposals are not suitable for providing sealing at the contact interfaces between the coils and the spark plug terminal pins.

The object of the present invention is to remedy the above drawbacks by proposing an integrated ignition-transformer assembly of particularly simple and reliable construction suitable for being individually associated with a conventional spark plug and requiring no major fundamental structural changes prior to being fitted to an existing heat engine.

SUMMARY OF THE INVENTION

The above objectives are achieved, by an integrated ignition-transformer assembly for the cylinder of a heat engine having controlled ignition, the assembly being of the type comprising a tubular body delimiting: an internal shoulder; mounting means on one side of said shoulder for mounting on the stem of a spark plug; and a housing on the other side of said shoulder containing an axially fixed transformer coil which is encapsulated in a dielectric coating and which includes a terminal for making contact with the spark plug;

said mounting means being constituted by disconnectable fixing means for co-operating with a complementary thread provided on the base of an adapted spark plug; and said terminal being in contact with the terminal pin of a spark plug and being surrounded by an internal sleeve of dielectric material which extends said transformer coil to said shoulder, and which is intended to receive, in sealed manner, the stem of the spark plug on which the assembly is mounted.

BRIEF DESCRIPTION OF THE DRAWINGS

An embodiment of the invention is described by way of example with reference to the accompanying drawings, in which:

FIG. 1 is a diagram showing the aim which can be achieved by means of the invention;

FIG. 3 is an electrical circuit diagram of one of the component parts of an assembly according to the invention.

MORE DETAILED DESCRIPTION

Figure 2:
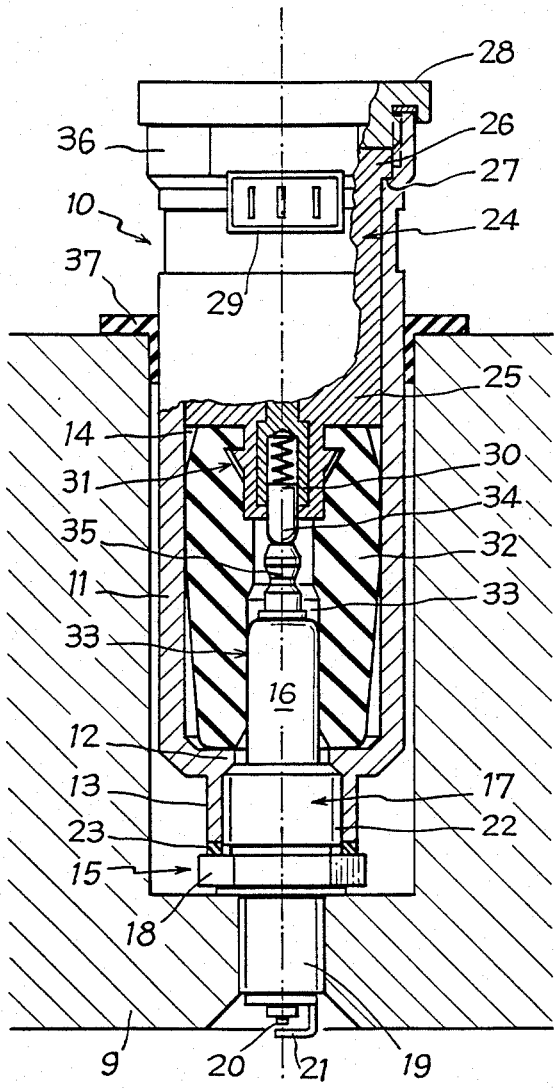
FIG. 2 is a partially cut-away elevation-section view of an assembly in accordance with the invention.

FIG. 1 is a diagram showing an ignition installation for a heat engine 1 of the internal combustion type having controlled ignition. By way of example, the engine 1 is illustrated in the form of an assembly including four cylinders 2 in which ignition is to be controlled selectively in a predetermined order. Naturally, the invention is applicable to an engine having some other number of cylinders 2.

An ignition installation 3 of such an engine 1 comprises a source of electrical energy 4 connected by a low tension cable 5 to distributor means 6 associated with control means 6a and itself connected via low tension cables 7 to each of the ignition spark plugs 8 mounted on the cylinder head 9 of the engine 1.

The invention lies in associating each spark plug 8 with an integrated ignition-transformer assembly 10 as shown in greater detail in FIG. 2. In FIG. 2, each assembly 10 comprises a tubular body 11 made of any suitable material for constituting an electromagnetic screen, in particular a metal or a plastic material with a conductive fill. On either side of an annular shoulder 12, the body 11 delimits a tapped hole 13 and a housing 14 which are preferably coaxial and which open out to respective opposite ends of the tubular body 11. The body 11 may be made as a single piece or it may comprise two pieces which are assembled together in sealed manner.

The tapped hole 13 is for mounting the body 11 on a spark plug 15 including a stem 16 which is connected by means of a base 17 to a flange 18 from which there extends a plug 19 fitted with electrodes 20 and 21. For this purpose, the spark plug 15 includes threads 22 on the base 17 which are complementary to the tapped hole 13 whose axial length is slightly less than the height of the base 17. A sealed assembly between the tapped hole 13 and the base 17 is ensured by a sealing ring 23 which is compressed between the open transverse end of the tubular body 11 and the flange 18. The axial length relationship between the tapped hole 13 and the thread 22 is also determined so as to ensure that once the sealing ring 23 has been partially compressed, positive abutment occurs with the base 17 engaging the shoulder 12.

The housing 14 contains a transformer coil 24 encapsulated in a dielectric coating 25 which centers it in the housing 14 and prevents it from moving axially. For this purpose, the coating 25 may form a flange 26 which is prevented from moving axially by being pressed against a shoulder 27 of the housing 14 by means of a stopper 28.

The transformer coil 24 extends beyond the tubular body 11 in the form of a connector 29 which is designed in any suitable manner to ensure a mechanically and electrically effective connection with a low tension connection cable 7. The connector 29 has three connection terminals, two of which are connected to a primary winding $E_1$ (see FIG. 3) with the other one being connected to a secondary winding $E_2$ which is connected to a contact terminal 30 located inside the body 11. The terminal 30 is surrounded by an end fitting 31 for being received in a sleeve 32 of dielectric material which is disposed inside the housing 14 between the coil 24 and the shoulder 12. The sleeve 32 has an axial bore 33 which is a tight fit around the stem 16 of a spark plug 15. In order to perform this function properly, the sleeve 32 is preferably designed and made of an elastomer capable of accepting resilient deformation, in particular in the radial direction, coming from its bore 33.

The end fitting 31 is designed to enable the sleeve 32 to be snap-fitted around the terminal 30 which is preferably constituted by a resiliently retractable stud 34 intended to co-operate with a terminal pin 35 which is normally to be found at the top end of the stem 16.

When the tubular body 11 is mounted on a spark plug 15, a unitary assembly is formed in which the terminal pin 35 comes into permanent contact with the stud 34 of the coil 24. In such an assembly, the contact surfaces between the stud 34 and the terminal pin 35 are confined inside the bore 33 which is isolated from the surroundings by the top stopper 28 and by the sealing ring 23, and by the sleeve 32 being a tight fit on the stem 16. This avoids the risk of foreign bodies or dampness gaining access to a point where they could spoil proper electrical contact. In addition, these surfaces are surrounded by the bulk of the sleeve 32 which constitutes an electrical insulator and which prevents any high tension leakage while increasing the leakage resistance between the stud 34 and both the base 17 and also the body 11. To this end, the tubular body 11 is preferably made in such a manner as to have a housing 14 of a diameter which is considerably greater than that of the tapped hole 13 so as to receive a sleeve 32 of considerble radial thickness.

The assembly 10 in accordance with the invention provides a unitary assembly which combines the functions of transforming low tension feed electricity into high tension and of providing ignition inside a cylinder. High tension current is transmitted directly between the contact stud 34 and the terminal pin 35 and thus avoids the need for any cable or connection end fitting which could give rise to leakage, to spark-over, to loss of energy, or to loss of dielectric continuity.

The integrated ignition-transformer assembly according to the invention can be manufactured practically and effectively by being subjected, in the factory, to various operating and sealing tests. Such an assembly may also be fitted directly onto an ignition spark plug without requiring any operations other than screwing the spark plug into the tapped hole 13 after inserting a sealing ring 23. The clamping torque applied can be accurately gauged between the clamping tools used, one being fitted to the flange 18 and the other to the head 36, both of which may be in the form of respective hex nuts, for example.

The assembly of the invention may thus be mounted as a unit prior to fitting the spark plug 15 to a cylinder, or alternatively it may be constituted after the spark plug has been fitted to the cylinder in conventional manner.

It should be understood that the function of the tapped hole 13 is to enable the body 11 to be fitted onto a spark plug 15 without transmitting stress to the stem 16. Some other assembly means could also be provided to achieve this purpose. For example, an assembly of the type including clamping via conjugate cones could also be designed.

An assembly according to the invention can be fitted to any type of spark plug mounted on a conventional cylinder head or in a cylinder head which includes deep spark plug-receiving wells. If the cylinder head does have such wells, then it is preferable for the tubular body 11 to be associated with a ring 37 of elastomer material suitable for centering and guiding the tubular body 11 and also for closing the well against ingress of any foreign bodies. The ring 37 may also have the function of limiting the mechanical stresses which may be transmitted to the base 17 by the vibration which is applied in operation to the mass constituted by the integrated ignition-transformer assembly.

In a preferred disposition of the invention, the body 11 delimits a housing 14 and a tapped hole 13 which are coaxial and which contains a coil 24 and a sleeve 32 which are likewise coaxial. The sleeve 32 could be an integral part of the coating 25 of the coil 24.

Compared with the prior art, making the ignition-transformer assembly in an integrated manner has the advantage of reducing losses between the coil and the spark plug, of providing better sealing which facilitates cold starting, and of very considerably reducing the emission of radio interference, more particularly if the body 11 is made of a magnetic metal constituting screening for the coil and the spark plug.

In addition, such a structure provides thermal protection for the coil and is also suitable for providing remote electronic control.

This construction may also be envisaged for capacitive or self-inductive ignition systems.

The invention is not limited to the example described and shown, since numerous modifications may be made thereto without going beyond the scope of the invention. In particular, the body 11 may be made of two component parts which are assembled together, e.g. by being screwed together.

I claim:

1. An integrated ignition-transformer assembly for the cylinder of a heat engine having controlled ignition, the assembly being of the type comprising a tubular body delimiting: an internal shoulder; mounting means on one side of said shoulder for mounting on the stem of a spark plug; and a housing on the other side of said shoulder containing an axially fixed transformer coil which is encapsulated in a dielectric coating and which includes a terminal for making contact with the spark plug;

said mounting means being constituted by disconnectable fixing means for co-operating with a complementary thread provided on the base of an adapted spark plug; and said terminal being in contact with the terminal pin of a spark plug and being surrounded by an internal sleeve of dielectric material which extends said transformer coil to said shoulder, and which is intended to receive, in sealed manner, the stem of the spark plug on which the assembly is mounted.

2. An assembly according to claim 1, wherein said mounted means and said housing are coaxial and are disposed on either side of said internal shoulder which constitutes an axial abutment for co-operating with said threaded base of a spark plug.

3. An assembly according to claim 1, wherein said transformer coil and said internal sleeve constitute an assembly which is put into place inside said tubular body via an open end situated at the opposite end to said disconnectable fixing means and closed by a sealed stopper, thereby axially fixing the coil and providing sealing for the coil and sleeve assembly.

4. An assembly according to claim 3, wherein said dielectric coating of the coil and said internal sleeve in said coil and sleeve assembly are constituted as a single piece.

5. An assembly according to claim 3, wherein said coil and sleeve assembly is made in two pieces.

6. An assembly according to claim 1, wherein, in order to make contact with the spark plug, said transformer coil includes said contact terminal which is encapsulated in said dielectric coating which constitutes an end fitting for said internal sleeve.

7. An assembly according to claim 6, wherein said terminal is constituted by a stud which is resiliently retractable, at least in part.

8. An assembly according to claim 1, wherein said internal sleeve delimits an axial bore constituting a tight fit over the stem of the spark plug.

9. An assembly according to claim 1, wherein said tubular body is associated with a ring for closing and centering a well in a cylinder head in which the body is mounted.

10. An assembly according to claim 3, wherein said tubular body and said stopper are made of a material suitable for providing electromagnetic screening.

* * * * *